United States Patent [19]

Holder

[11] 3,976,564

[45] Aug. 24, 1976

[54] COMBINATION DIGGER AND SIFTER FOR USE WITH METAL DETECTOR

[76] Inventor: Gradie R. Holder, 11 Buffalo, Clarkston, Mich. 48016

[22] Filed: Feb. 27, 1975

[21] Appl. No.: 553,554

[52] U.S. Cl. ..... 209/38; 209/417; 240/2 E

[51] Int. Cl.[2] ..... B03C 1/30

[58] Field of Search ..... 209/38, 417, 418, 215, 209/375, 376, 357, 372, 420, 235, 237, 419; 172/438; 240/2 E, 6.46; 210/470

[56] References Cited

UNITED STATES PATENTS

| | | | |
|---|---|---|---|
| 543,710 | 7/1895 | Tate | 209/419 |
| 660,527 | 10/1900 | Crowther | 209/419 |
| 661,774 | 11/1900 | Sheehy | 209/419 X |
| 1,554,525 | 9/1925 | Ricci | 209/419 |
| 1,646,787 | 10/1927 | Elmenthaler | 209/419 |
| 2,355,086 | 8/1944 | Lang | 240/2 E X |
| 2,477,498 | 7/1949 | Springs | 240/6.46 X |
| 2,594,908 | 4/1952 | Gaulke | 240/2 E X |
| 2,822,089 | 2/1958 | Woodruff | 209/38 X |
| 3,316,545 | 4/1967 | Reed | 209/420 X |
| 3,655,960 | 4/1972 | Andree | 240/2 E X |
| 3,924,115 | 12/1975 | Hampton | 240/6.46 |

*Primary Examiner*—Robert Halper
*Attorney, Agent, or Firm*—Irving M. Weiner; Pamela S. Burt

[57] ABSTRACT

A device for use in conjunction with a metal detector which will allow the user to dig and sift simultaneously with one hand. The device includes a shovel type scoop with a flashlight built into the handle. The scoop is perforated so that it can be used in the manner of a sifter looking for metal particles or other objects. The holder or handle has a ring attachment for conveniently carrying on a belt. Optionally, the holder scoop may be magnetically treated in order to capture small metallic objects which might otherwise fit through the perforations.

10 Claims, 5 Drawing Figures

COMBINATION DIGGER AND SIFTER FOR USE WITH METAL DETECTOR

The present invention relates generally to an apparatus for locating and separating objects from a medium in which such objects are disposed. In particular, the present invention relates to an apparatus or device for use in conjunction with a metal detector which will allow the user or operator to dig and sift simultaneously with one hand.

The phraseology and terminology "objects" as used herein is intended to include and embrace anything which is perceptible by one or more of the senses, especially something that can be seen and felt, and is not limited or restricted to metallic items.

Furthermore, the terminology and phraseology "medium" as used herein is intended to connote generally any surrounding or pervading substance in which bodies or objects exist or move, and includes, but is not limited to, sand, earth, water, dirt, mud, gravel, etc.

BACKGROUND OF THE INVENTION

There is an increasing trend in the number of people becoming interested in amateur prospecting, treasure hunting, metal detecting, amateur geology, and amateur archaeology within the United States and foreign countries. The upsurge in this interest appears to be motivated, at least in part, by the desire of many to return to nature for an enjoyable and educational hobby. With the increased interest in these pastimes, there has arisen a commensurate interest in implemented tools for use in pursuing the pastimes.

One of the most popular implements used in pursuing the above-mentioned hobbies and allocations is the metal detector. Some of such metal detectors are similar in design to the older detectors which were used by the military to locate land mines and other types of explosives and metals.

Heretofore, various attempts have been made to find a suitable apparatus which could be used both for digging and for sifting. However, such prior art attempts possess numerous disadvantages, are too cumbersome and complicated, and cannot be used readily, easily and conveniently for digging and sifting simultaneously while being held with only one hand of the user.

Such prior attempts are exemplified by: U.S. Pat. No. 645,956 patented on Mar. 27, 1900 by W. P. Hyrons and entitled "COMBINED SHOVEL AND SIFTER"; U.S. Pat. No. 657,508 which was patented on Sept. 11, 1900 by W. W. Brown and entitled "COAL SCREEN"; U.S. Pat. No. 681,608 which was patented on Aug. 27, 1901 by G. P. Baughman and entitled "COMBINED SCOOP AND SIFTER"; and U.S. Pat. No. 2,005,416 patented on June 18, 1935 by J. H. Fisher and entitled "COAL SHOVEL".

One of the principal objects of the present invention is to provide a lightweight and convenient apparatus or device for use in conjunction with a metal detector which will allow the user to dig and sift simultaneously with one hand, and at the same time provide a built-in flashlight in the handle of the device.

SUMMARY OF THE INVENTION

The present invention provides an apparatus for locating and separating objects from a medium in which such objects are disposed. The apparatus includes first means for temporarily retaining therein at least a portion of said medium which may contain one or more of said objects to be located and separated from said medium. The first means is provided with a plurality of apertures through which said portion of such medium may pass. The apertures are dimensioned, located and shaped in the first means so as to facilitate and expedite the passage therethrough of said portion of said medium which is temporarily retained in said first means and substantially simultaneously to obstruct and impede the passage therethrough of at least some of said objects to be located and separated from said medium. The apparatus also includes a second means which is operatively interconnected with such first means to enable the entire apparatus to be readily held by one hand of a person utilizing such apparatus. The apparatus also includes a third means operatively interconnected with said second means for facilitating and assisting the visual detection of the objects remaining in said first means after substantially all of said portion of said medium has passed through said apertures provided in said first means.

It is an object of the present invention to provide a device to be used with a metal detector in finding various buried objects.

In accordance with a first preferred embodiment of the present invention, the holder scoop apparatus is shaped like a spade to permit digging in harder dirt or earth.

In accordance with a second preferred embodiment of the present invention, the holder scoop apparatus is shaped like a basket which is especially useful in connection with sifting in soft sand, or underwater, or in any environment where the medium involved is fluid or liquid in nature.

It is a further option of the present invention to provide a combination digger-sifter apparatus having a built-in light in order to see what is in the scoop or on the surface thereof.

Yet another object of the present invention is to provide a holder scoop wherein the portion provided with the perforations or apertures is magnetic in order to retain small objects which would otherwise pass through such apertures or perforations.

A further object of the present invention is to provide an apparatus or a device for use in conjunction with a metal detector, but is not to be restrict or limited to use in conjunction with a metal detector, which will allow the user to dig and sift simultaneously with one hand.

It is an additional object of the present invention to provide a novel scoop apparatus which will double as a hand shovel and a sand sifter for use in combing sand, earth or some other medium in conjunction with a metal detector.

Other objects of the present invention will appear from the following specification description and appended claims, with reference being had to the accompanying drawings forming a part of the specification wherein like reference characters are intended to designate corresponding parts in the several views.

DETAILED DESCRIPTION OF SOME PREFERRED EMBODIMENTS OF THE PRESENT INVENTION

Before explaining the present invention in detail, it should be understood that the present invention is not limited in its application or construction to the details of the arrangement of parts and construction illustrated in the accompanying drawings, because the present invention is capable of other embodiments and modifications and of being practiced or carried out in various ways. Furthermore, it should also be understood that the phraseology or terminology employed herein is for the purpose of description and illustration only, and not of limitation or restriction.

Figure 1:
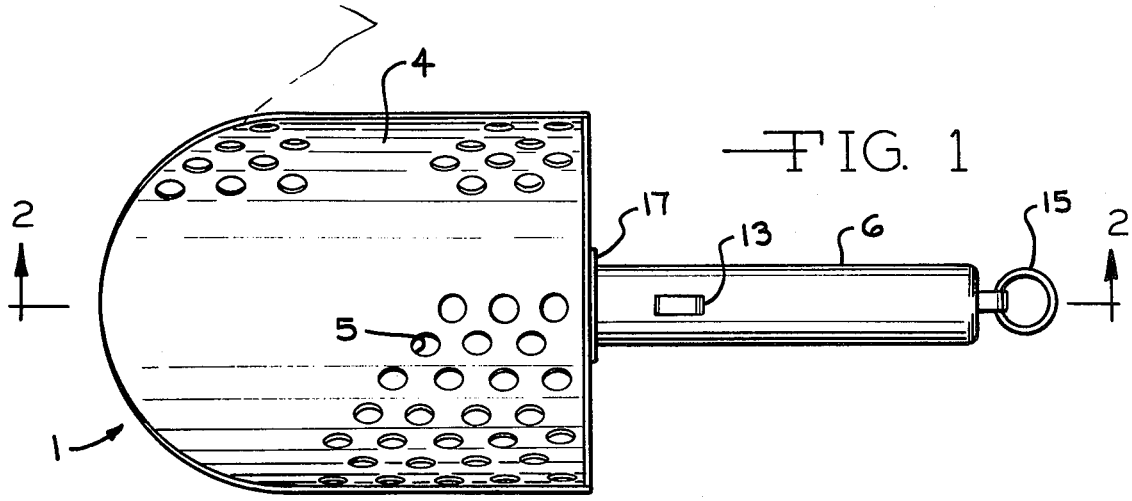
FIG. 1 illustrates a top plan view of the novel combination digger and sifter apparatus according to a first embodiment of the invention.
Figure 2:
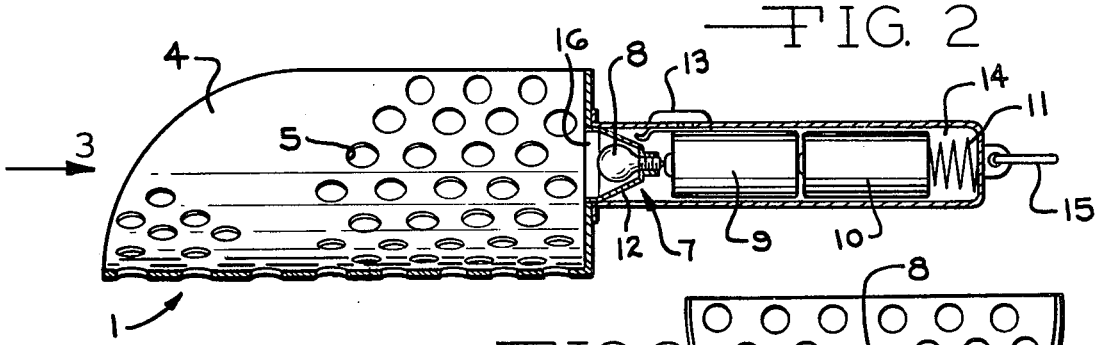
FIG. 2 illustrates a longitudinal sectional view of the FIG. 1 apparatus taken along the line 2—2 shown in FIG. 1.
Figure 3:
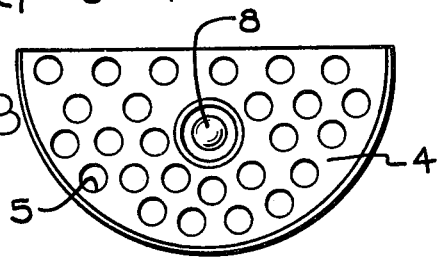
FIG. 3 illustrates a front elevational view of the apparatus depicted in FIGS. 1 and 2 as viewed in the direction indicated by the arrow 3 shown in FIG. 2.

With reference to FIGS. 1, 2 and 3 of the drawings, there is illustrated on apparatus or device 1 according to a first preferred embodiment of the present invention. The novel apparatus 1 is especially useful for locating and separating objects, such as metal coins, from a medium, such as sand, in which such objects may be disposed.

The apparatus 1 includes first means, such as a perforated scoop 4, for temporarily retaining therein at least a portion of the aforesaid medium which may contain one or more of the aforesaid objects to be located and separated from said medium.

The scoop 4 is provided with a plurality of perforations or apertures 5 through which said portion of said medium may pass. The apertures 5 are dimensional, located and shaped in the scoop 4 so as to facilitate and expedite the passage therethrough of said portion of said medium which is temporarily retained in scoop 4 and substantially simultaneously to obstruct and impede the passage therethrough of at least some of said objects to be located and separated from said medium.

The apparatus 1 also comprises second means, including a handle 6, which is operatively interconnected with the scoop 4 to enable the entire apparatus 1 to be readily held by one hand of a person utilizing the apparatus 1.

The apparatus 1 also includes third means, such as an illumination device 7, which is operatively interconnected with or disposed within the handle 6 for facilitating and assisting the visual detection of objects remaining in scoop 4 after substantially all of said portion of said medium has passed through the apertures 5 provided in the scoop 4. The illumination device 7 may comprise an electric light or flashlight including bulb 8 which is disposed in electrical contact with the positive terminal of a first battery 9, which in turn is disposed in electrical contact with a second battery 10. As shown in FIG. 2, the illumination or light device 7 also includes an electrically conductive spring 11 which mechanically urges and retains batteries 9 and 10 in electrical contact with the bulb 8, and at the same time ensures electrical contact with the metallic casing structure 12 disposed in the handle 6. The light 7 also includes a switch 13 for energizing and de-energizing the illumination device 7.

With further reference to FIG. 2, the handle 6 includes at least one hollow portion 14 therein for housing and at least partially enclosing the illumination device 7. Preferably, the handle 6 should comprise a water-proof handle which is provided with a device, such as a clip or ring 15, at one end thereof for facilitating the removable hanging of the apparatus 1 from a belt or other apparel of the person utilizing the apparatus 1. In order to make the handle water-proof, there is included a flashlight lens 16 and one or more gaskets 17.

It should be noted with reference to FIGS. 2 and 3, that the apparatus 1 is thus provided with a structure, formed by bulb 8, casing structure 12 and flashlight lens 16, in the area where the handle 6 interconnects with the scoop 4 for enabling the electric lighting device 7 to illuminate all of the apertures 5 which are provided in the scoop 4.

Figure 4:
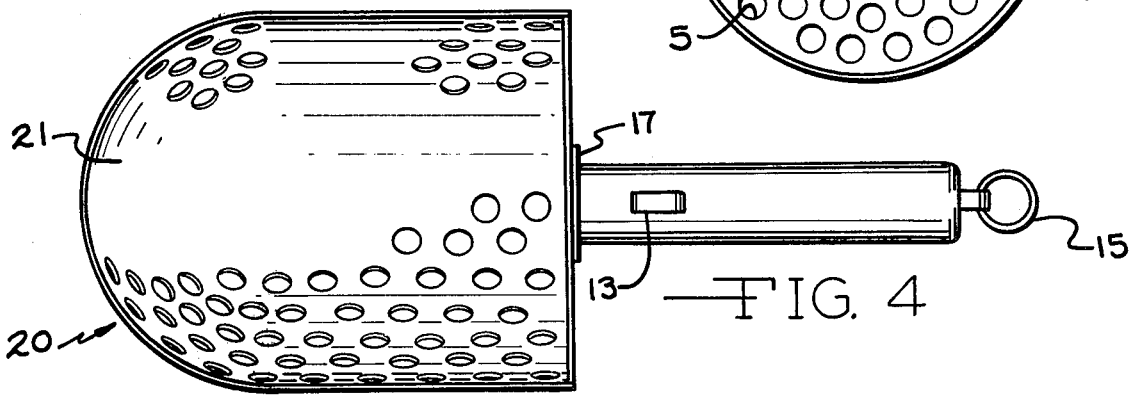
FIG. 4 illustrates a top plan view of a second preferred embodiment of the present invention which has a basket-like configuration.
Figure 5:
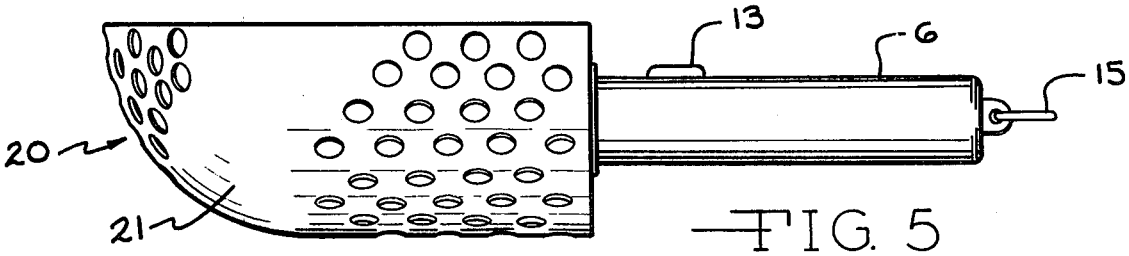
FIG. 5 illustrates a side elevational view of the apparatus depicted in FIG. 4.

Referring now to FIGS. 4 and 5, there is illustrated an apparatus 20 according to a second preferred embodiment of the present invention. The apparatus 20 is similar in many respects and components to that described hereinabove with reference to the apparatus 1 shown in FIGS. 1, 2 and 3. However, whereas the scoop 4 of the apparatus 1 had a spadelike configuration and shape, in contrast the apparatus 20 includes a scoop 21 which has a basket-like configuration and shape. The apparatus 20 is particularly suitable for searching for objects disposed in soft sand, or a fluid medium. On the other hand, the apparatus 1 depicted in FIGS. 1–3 is particularly suitable for digging and sifting in harder media or terrain.

It should be carefully noted that both of the above-described apparatuses 1 and 20 will permit the user to dig and sift simultaneously with the use of only one hand. This is an especially useful advantage when the novel apparatus is employed in conjunction with a metal detector.

Essentially, the apparatus according to the present invention comprises a perforated scoop 4 or 21 with a flashlight 7 which is built into the scoop handle 6. The handle 6 may also be provided with a clip or ring 15 for use in attaching the entire assembly to the belt or other piece of apparel of the user.

The present invention provides an apparatus 1 or 20 which is corrosion-free, extremely light in weight, provided with a water-proof light 7 built into the handle 6, it is perforated with apertures or holes 5 for ease in sifting, and is to be attachable to the user's gear or clothing. The perforated scoop 4 or 21 may be metallic or non-metallic and made from any suitable material. For example, the scoop may be fabricated from high density polyethylene.

Optionally, if desired, the scoop 4 or 21 may be magnetized in order to capture and retain on the scoop 4 or 21, respectively, any objects which would otherwise pass through the apertures 5.

There is set forth hereinbelow a description of an actual working embodiment of the present invention which is non-magnetic in nature. The objective of such working embodiment is to attain a "sifter" for earth or other media being searched for metallic particles, and is designed to be used with metal detectors. The entire unit is non-magnetic.

In such actual working embodiment, the scoop section 4 or 21 is approximately 8 inches long, and is integral or attached to a 6 inch handle 6. The scoop area, including the back thereof, if perforated with 7/16 inch diameter holes. The basic material was high density polyethylene, with a copper strip in a flashlight 7 for grounding. The flashlight unit 7 is completely sealed so as to be water-proof. The hanging ring 15 may also be fabricated from polyethylene. Two D dry cell batteries may be used in the light 7.

The materials used in fabricating such working embodiment comprise: one square foot of ⅛ inch thick rigid polyethylene; one copper strip ¼ inch by 6 inches; one flashlight bulb; one flashlight lens; two gaskets 17; one switch 13; one hanging loop 15; one coil spring 11; one neoprene switch cover; and one lens cover.

In accordance with the present invention, the handle 6 may be formed or molded integral with the scoop, or in the alternative, the handle 6 may be bonded or welded or in another manner affixed to the scoop but made initially in separate parts.

It is believed that with the above description and illustration, the various features of the present invention will be apparent. For a definition of the scope of the present invention, reference should be had to the following appended claims.

I claim:

1. An apparatus for locating and separating objects from a medium in which said objects are disposed, comprising, in combination:

first means for temporarily retaining therein at least a portion of said medium which may contain one or more of said objects to be located and separated from said medium;

said first means being provided with a plurality of apertures through which said portion of said medium may pass;

said apertures being dimensioned, located and shaped in said first means so as to facilitate and expedite the passage therethrough of said portion of said medium which is temporarily retained in said first means and substantially simultaneously to obstruct and impede the passage therethrough of at least some of said objects to be located and separated from said medium;

second means operatively interconnected with said first means to enable the entire apparatus to be readily held by one hand of a person utilizing said apparatus; and third means disposed within said second means for facilitating and assisting the visual detection of objects remaining in said first means after substantially all of said portion of said medium has passed through said apertures provided in said first means.

2. An apparatus characterized in accordance with claim 1, wherein:

at least a portion of said first means adjacent said apertures is magnetic for obstructing and impeding the passage through said apertures of at least some of said objects to be located and separated which may possess dimensions which are smaller than the dimensions of said apertures.

3. An apparatus characterized in accordance with claim 2, wherein:

said second means comprises a handle;

said third means comprises an electric lighting device disposed within said handle; and there is provided a structure in the area where said second means interconnects with said first means for enabling said electric lighting device to illuminate substantially all of said apertures which are provided in said first means.

4. An apparatus characterized in accordance with claim 2, wherein:

said third means comprises an illumination device which includes at least one electric battery which is electrically and operatively connected to at least one electric light bulb and at least one switch which is operatively and electrically connected to said battery and bulb;

said second means comprises a handle to which said switch is secured; and said handle includes at least one hollow portion therein for housing and at least partially enclosing said illumination device.

5. An apparatus characterized in accordance with claim 1, wherein:

said second means comprises a water-proof handle which is provided with a device at one end thereof for facilitating the removable hanging of said apparatus from a belt of said person utilizing said apparatus.

6. An apparatus characterized in accordance with claim 1, wherein:

said third means includes an electric light.

7. An apparatus characterized in accordance with claim 1, wherein:

said second means comprises a handle;

said third means comprises an electric lighting device disposed within said handle; and there is provided a structure in the area where said second means interconnects with said first means for enabling said electric lighting device to illuminate substantially all of said apertures which are provided in said first means.

8. An apparatus characterized in accordance with claim 1, wherein:

said third means comprises an illumination device which includes at least one electric battery which is electrically and operatively connected to at least one electric light bulb and at least one switch which is operatively and electrically connected to said battery and bulb;

said second means comprises a handle to which said switch is secured; and said handle includes at least one hollow portion therein for housing and at least partially enclosing said illumination device.

9. An apparatus characterized substantially in accordance with claim 1, wherein:

said first means possesses a spade-like configuration and shape.

10. An apparatus characterized substantially in accordance with claim 1, wherein:

said first means possesses a basket-like configuration and shape.

* * * * *